US006164757A

United States Patent [19]

Wen et al.

[11] Patent Number: 6,164,757

[45] Date of Patent: Dec. 26, 2000

[54] APPARATUS FOR PRINTING PROOF IMAGE AND PRODUCING LITHOGRAPHIC PLATE

[75] Inventors: Xin Wen, Rochester; Thap DoMinh, Webster; Charles D. DeBoer, Palmyra, all of N.Y.

[73] Assignee: Eastman Kodak Company, Rochester, N.Y.

[21] Appl. No.: 08/961,058

[22] Filed: Oct. 30, 1997

[51] Int. Cl.[7] ..... B41J 2/21

[52] U.S. Cl. ..... 347/43; 347/103

[58] Field of Search ..... 347/43, 84, 102, 347/103, 105, 100, 101

[56] References Cited

U.S. PATENT DOCUMENTS

| | | | |
|---|---|---|---|
| 4,303,924 | 12/1981 | Young, Jr. | 347/102 |
| 4,833,486 | 5/1989 | Zerillo | 347/2 |
| 4,978,969 | 12/1990 | Chieng | 347/102 |
| 5,275,646 | 1/1994 | Marshall et al. | 347/100 |
| 5,493,321 | 2/1996 | Zwadlo | 347/131 |
| 5,598,196 | 1/1997 | Braun | 347/68 |
| 5,605,750 | 2/1997 | Romano et al. | 347/105 |
| 5,646,656 | 7/1997 | Leonhardt et al. | 347/43 |
| 5,771,810 | 6/1998 | Wolcott | 347/43 |
| 5,865,116 | 2/1999 | Keller et al. | 101/148 |

FOREIGN PATENT DOCUMENTS

| | | |
|---|---|---|
| 0 488 530 | 10/1991 | European Pat. Off. . |
| 0 533 168 | 9/1992 | European Pat. Off. . |

*Primary Examiner*—N. Le
*Assistant Examiner*—Lamson D. Nguyen
*Attorney, Agent, or Firm*—Raymond L. Owens

[57] ABSTRACT

A drop-on-demand ink jet printing apparatus for printing proof images and then producing at least one lithographic printing plate in response to an input image includes a computer adapted to receive the input digital image and a plurality of ink reservoirs for providing inks of different colors for printing proof images and at least one lithographic ink reservoir for producing a lithographic printing plate. First print heads coupled to a proof image receiver and responsive to the computer for transferring particular inks onto the proof image receiver for producing proof images; and a second print head responsive to the computer for transferring lithographic ink from the lithographic ink reservoir to form an image pattern on the lithographic printing plate.

5 Claims, 3 Drawing Sheets

APPARATUS FOR PRINTING PROOF IMAGE AND PRODUCING LITHOGRAPHIC PLATE

CROSS REFERENCE TO RELATED APPLICATIONS

The present invention is related to commonly assigned U.S. patent application Ser. No. 09/090,581 filed Jun. 4, 1998, titled "Printing Plate and Method of Preparation" to Simons, and commonly assigned U.S. patent application Ser. No. 08/934,370 filed Sep. 19, 1997, titled "Ink Jet Printing With Radiation Treatment" to Wen. The disclosure of these related applications is incorporated herein by reference.

FIELD OF THE INVENTION

This invention relates to apparatus for printing proof images, lithographic printing plates, flexographic printing plates, graphic arts photomasks, gravure printing cylinders and other graphic arts media.

BACKGROUND OF THE INVENTION

In the printing industry, graphical information such as photographs or artwork can be reproduced by one of several types of printing process. Lithographic printing is one such printing process. In lithographic printing, a lithographic plate is mounted on a lithographic press. The lithographic plate includes a hydrophilic surface on which an image is created using hydrophobic material. A hydrophobic ink is used in printing. The ink is attracted to the hydrophobic image area on the plate and is repelled by the hydrophilic non-imaged area on the lithographic printing plate. The inked image is then used for making lithographic prints. The lithographic printing process is a complex process involving wet chemicals and costly equipment.

Color proofing is an integral part of the printing reproduction process. Color proofs are used to predict the appearance of the final reproduction, to monitor and control the many stages of the image reproduction process, and to check the compatibility of a number of subjects to be printed on the press at the same time. For a color proof to be acceptable to a customer, it is required to be a close simulation of the final printing job. To be acceptable to the printer, the proof must be capable of being produced consistently. The proof must look and preferably feel like the printed job. For this reason, most proofs in the past have been made on printing presses with the same paper and inks to be used on the printed job. The proof sheets are sent to the a selector (a critic for judging images) who determines whether or not their initially selected images are indeed suitable for the desired publication. If the images are not suitable, another round of proof sheets may be generated using different images or different printing parameters. This iterative process can be very costly and time consuming.

In order to reduce the costs of generating proofs, several proof processes have been devised, which include overlay proofs, integral proofs, and digital proofs such as the Kodak Approval system. For example, IRIS Graphics, Inc. (Scitex Co.) has used a continuous ink jet printer to print proof images. In a trade show known as Print'97 in Chicago, the same company demonstrated that a continuous ink jet printer can also be used to produce a lithographic printing plate. In spite of these efforts, however, there remain substantial problems in getting images selected and ready for inclusion in a publication. For example, a proof press still uses a complex and expensive piece of equipment. Additionally, many proof presses often do not duplicate well the final printing job due to the substantial differences in the small proof printing press and the large printing press used for the final production process.

There still exists a need to provide a simplified process and less expensive equipment for making image proofs, lithographic printing plates, flexographic printing plates, graphic arts photomasks, gravure printing cylinders and other graphic arts media.

SUMMARY OF THE INVENTION

It is an object of the present invention to provide a simple and inexpensive apparatus for producing proof images, lithographic printing plates, and other graphic arts media.

It is a further object of the present invention to provide proof images that will closely correspond to images produced by the lithographic printing process.

These objects are achieved by a drop-on-demand ink jet printing apparatus for printing proof images and then producing at least one lithographic printing plate in response to an input image, comprising:

a) a computer adapted to receive the input digital image;

b) a plurality of ink reservoirs for providing inks of different colors for printing proof images and at least one lithographic ink reservoir for producing a lithographic printing plate or other graphic arts media;

c) first print head means coupled to a proof image receiver and responsive to the computer for transferring particular inks onto the proof image receiver for producing proof images; and d) second print head means responsive to the computer for transferring lithographic ink from the lithographic ink reservoir to form an image pattern on the lithographic printing plate or other graphic arts media.

ADVANTAGES

A feature in accordance with the present invention is that a proof image and a lithographic printing plate are both produced by one shared drop-on-demand ink jet printing apparatus.

Another feature is that ink jet printing apparatus in accordance with the present invention is non-impact, low-noise, low energy use, low cost, and does not involve wet chemical processing.

A further feature of the present invention is that the production of the proof images and the printing plate can be made rapidly by using a multiple of ink nozzles in each print head.

A still further feature in accordance with the present invention is that the proof image and the lithographic printing plate are produced in a significantly similar manner so that the proof image can reproduce the final printing job with high-fidelity.

DETAILED DESCRIPTION OF THE INVENTION

The present invention is described with relation to an apparatus that is capable of producing both proof images and lithographic plates or other graphic arts media. By other graphic arts media those skilled in the art will understand that, flexographic printing plates, graphic arts photomasks, gravure printing cylinders and reusable offset lithographic printing cylinders are included.

Figure 1:
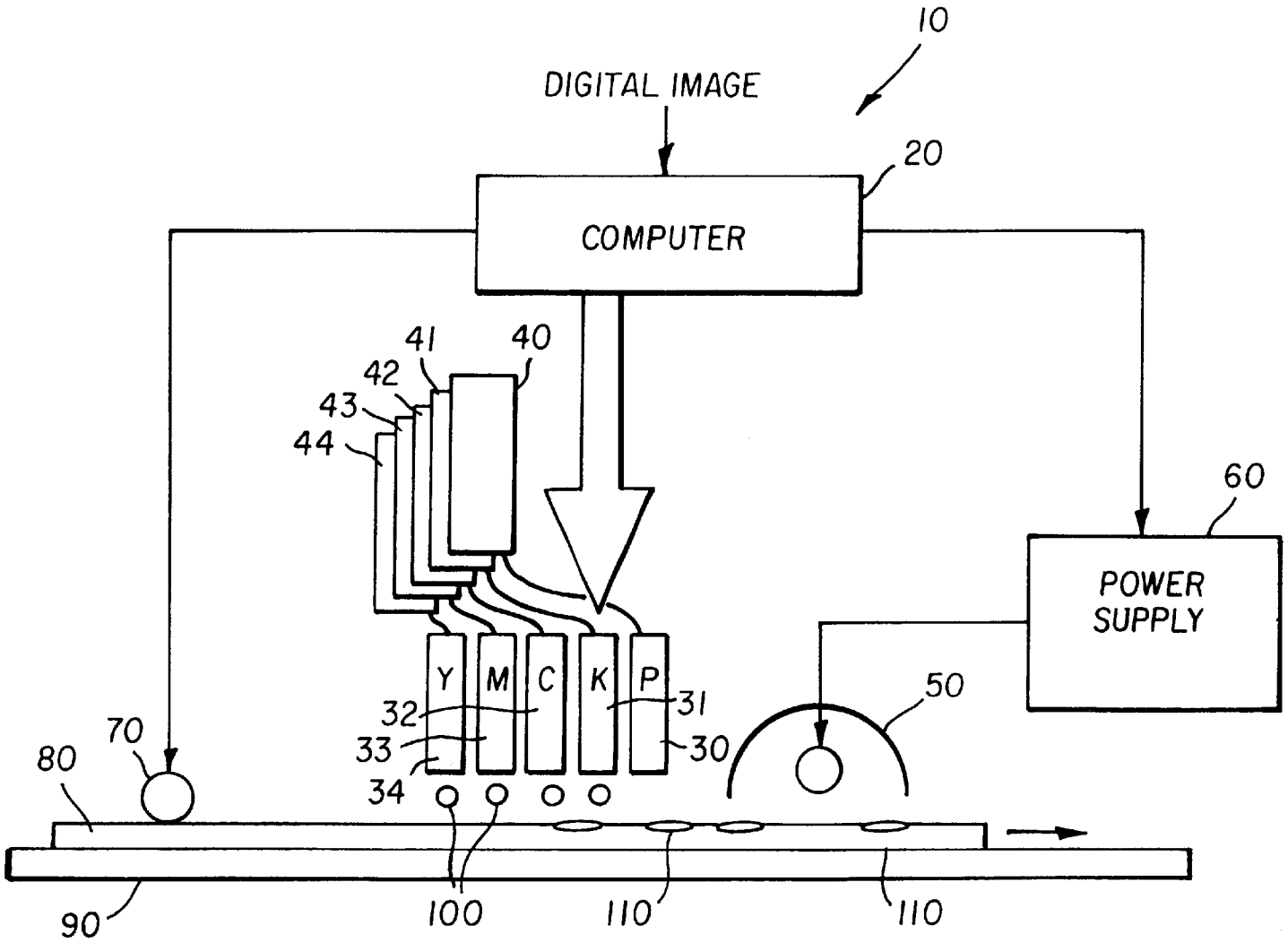
FIG. 1 is a schematic diagram of a printing apparatus in accordance with the present invention showing the printing of a proof image.
Figure 2:
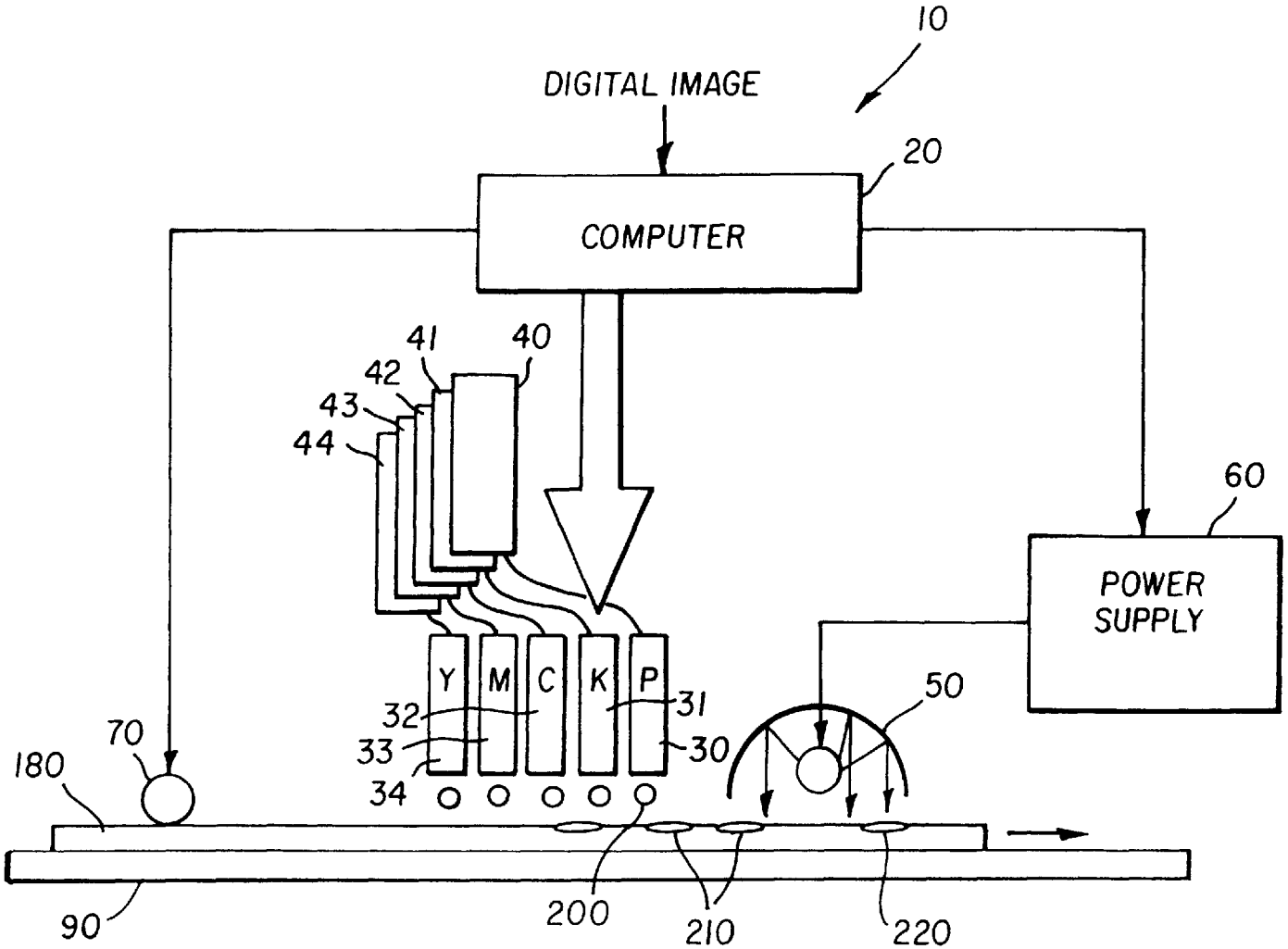
FIG. 2 is a schematic diagram of the printing apparatus in accordance with the present invention showing the printing of a lithographic printing plate.

Referring to FIGS. 1 and 2, a drop-on-demand ink jet printing apparatus 10 is shown to comprise a computer 20, ink jet print heads 30–34, a plurality of ink reservoirs 40–44, a UV light source 50 and a power supply 60 for the UV light source 50, and a receiver transport 70. The drop-on-demand ink jet printing apparatus 10 operates with either a proof image receiver 80, shown in FIG. 1, or a lithographic printing plate 180 shown in FIG. 2. Both of these elements are shown to be supported by a platen 90. The computer 20 can take many forms known in the art and may, for example, include a microprocessor and a user interface. Stored within the memory of the computer are image enhancing programs such as halftoning algorithms which are, of course, well known in the art. In the present invention, the term drop-on-demand ink jet printer refers to the types of the ink jet printers that selectively activate the ink jet chambers to produce an imagewise pattern on a receiver. The drop-on-demand ink jet printers are typically lower cost than the continuous ink jet printers used in the prior art. Furthermore, a plurality of ink nozzles can be fabricated in each drop-on-demand print head. The print heads 30–34 can exist in different forms, for example, piezo-electric or thermal ink jet print head. An example of a piezoelectric ink jet print head is shown in commonly assigned U.S. Pat. No. 5,598,196. Print head 30 is labeled P for lithographic ink. In the present invention, lithographic ink refers to any colorless or colored fluids that can produce image wise pattern on a lithographic printing plate for printing applications. Print head 31 is labeled K for black ink. Print head 32 is labeled C for cyan ink. Print head 33 is labeled M for magenta ink and print head 34 is labeled Y for yellow.

The ink reservoirs 41–44 respectively contain black, cyan, magenta, and yellow inks that are supplied to the ink jet print heads 31–34 of the corresponding colors. Although not shown in FIGS. 1 and 2, the drop-on-demand ink jet printing apparatus 10 can also include inks of other colors such as red, green, blue, etc. Several ink densities can also be used for each color. The colorants in the inks can be dyes or pigments. In addition to the colorants, the ink formula can further include stabilizers, surfactants, viscosity modifiers, humectants and other components. Examples of the colored inks are disclosed in U.S. Pat. No. 5,611,847, as well as the following commonly assigned U.S. patent application Ser. No. 08/699,955 filed Aug. 20, 1996, titled "Cyan and magenta Pigment Set"; Ser. No. 08/699,962 filed Aug. 20, 1996, titled "Magenta Ink Jet Pigment Set"; Ser. No. 08/699,963 filed Aug. 20, 1996, titled "Cyan Ink Jet Pigment Set"; Ser. No. 08/790,131 filed Jan. 29, 1997, titled "Heat Transferring Inkjet Images"; and Ser. No. 08/764,379 filed Dec. 13, 1996, titled "Pigmented Inkjet Inks Containing Phosphated Ester Derivatives"; the disclosures of which are incorporated by reference herein. Colorants such as the Ciba Geigy Unisperse Rubine 4BA-PA, Unisperse Yellow RT-PA, and Unisperse Blue GT-PA can also be used in the inks of the present invention.

Although a lithographic ink and associated print head are illustrated in FIGS. 1 and 2 for producing lithographic printing plates, it is understood that the present invention is also compatible with other inks and corresponding print heads that can be used for image setting and screen printing applications.

In accordance with the present invention, referring to FIG. 1, a proof image is printed on a proof image receiver 80 by the drop-on-demand ink jet printing apparatus 10. The proof image receiver 80 can be common paper having sufficient fibers to provide a capillary force to draw the ink from the mixing chambers into the paper. Synthetic papers can also be used. The receiver can comprise a layer that is porous to the inks, an ink absorbing layer, as well as materials with a strong affinity and mordanting effect for the inks. Exemplary receivers are disclosed in U.S. Pat. No. 5,605,750. The proof image receiver 80 is supported by the platen 90. The proof image receiver 80 is transported by the receiver transport 70 under the control of the computer 20. The movement direction of the receiver during printing is indicated by the arrow in FIG. 1. The platen 90 can exist in many forms such as a flat platen surface as shown in FIGS. 1 and 2, or an external or internal drum surfaces. The print heads can also be transported relative to the proof image receiver 80 (or the lithographic plate 180 in FIG. 2) during printing.

A digital image is applied to the computer 20. Alternatively, the computer 20 can produce this digital image itself. The image is typically processed by a halftoning algorithm. The computer 20 controls the print head 31–34 according to the digital image data to eject colored ink drops 100 to form colored ink spots 110 on the image proof receiver 80. To avoid excessive ink on the image proof receiver 80, a proof image can be printed in a multiple number of printing passes.

The above described proof printing is made by a non-impact, low-noise and low energy ink jet printing apparatus. The printing process is low cost, and does not involve wet chemicals. After the proof image is prepared, the proof image is reviewed by a selector. As will be understood to those in this art, after a selector views an image if it is acceptable or unacceptable. If the image is unacceptable, then changes to image are provided into the computer 20 through its user interface. These changes, as well known in the art, can effect the image content or on printing parameters such as those for the halftoning algorithm. The improved proof image is printed. After one or a few iterative cycles, a satisfactory proof image as determined by the selector is obtained.

In accordance with the present invention, now referring to FIG. 2, a lithographic printing plate is subsequently prepared by the same drop-on-demand ink jet printing apparatus 10. Furthermore, the lithographic printing plate is produced by the same printing parameters such as the halftoning algorithm as those used in the above proof printing process. These features represent significant advantages in saving equipment costs, process time, and more importantly, improving the fidelity of the image proof relative to the final printing job.

FIG. 2 shows the same drop-on-demand ink jet printing apparatus 10 including a lithographic printing plate 180 which can be a plate to be mounted to a lithographic printing press, or alternatively, the surface of the plate cylinder of the lithographic press. Typically, one lithographic plate is used for each color plane. The lithographic printing plate 180 is placed on the platen 90, and is transported by the receiver transport 70 under the control of the computer 20. The movement direction of the receiver during printing is indicated by the arrow in FIG. 1.

The same digital image that produced the satisfactory proof image as described above is applied to the computer 20. The computer 20 controls the print head 30 according to the digital image data of the proper color plane. The print head 30 ejects curable ink drops 200 to form curable ink spots 210 on the lithographic printing plate 180. The curable ink in the print head 30 is supplied by the ink reservoir 40.

The curable inks transferred to the lithographic printing plate 180 can be optionally cured by different ink curing techniques such as radiation or thermal treatment, which greatly increases the durability and lifetime of the printing plate. In the present invention, the terms cure or curing also include processes such as drying, absorption of fluids by an ink media, and evaporation, which do not require a separate means for curing the inks. In FIG. 2, the curable ink spots 210 transferred to the lithographic printing plate 180 are treated by a UV light source 50. The computer 20 controls the power supply 60 which in turn provides an input voltage to the UV light source. The radiation of the UV light causes the curable ink to form cured ink spots 220 (in black color) on the lithographic printing plate 180. One example of an UV light source is a mercury arc lamp.

In the present invention, the term radiation refers to the application of photons or other particles such as UV or visible photons, infrared photons, and electron beam radiation. An UV light source is shown in FIG. 1, but it is understood that other types of radiation sources can also be used in the present invention. The curable ink that is contained in ink reservoir 40 comprises photoinitiators and photoactivators that can be cured by UV-irradiation and other types of radiation such as electron irradiation. In the present invention, the term cure refers to the processes that harden or solidify the curable ink spots 210 on the lithographic printing plate 180, which can be polymerization, crosslinking, melting-freezing reaction, glass transition, and other similar processes. The curing of the curable ink spots 210 on the lithographic printing plate 180 greatly improves the physical durability as well as the image stability (such as waterfastness and lightfastness) of the printed ink image.

UV curable inks are known to a person skilled in the art of ink jet printing. A range of commercial monomers, e.g. having acrylic, vinyl or epoxy functional groups, photoinitiators and photoactivators is available and suitable for use in an ink-jet formulation, capable of polymerization by UV light. The reaction may proceed through addition polymerization; all reactants are converted to the final polymeric binder, leaving no by-product or trace of liquid. This reaction can proceed in two processes, either by a free-radical mechanism or by the formation of a cationic species, or combination of both processes. UV curable ink compositions can be found in U.S. Pat. Nos. 4,303,924; 4,833,486; 5,275,646;, EP Patent Publication No. 407054; EP Patent 488,530 A2; and EP Patent 533,168 A1. The disclosure of these references is incorporated herein by reference.

Figure 3:
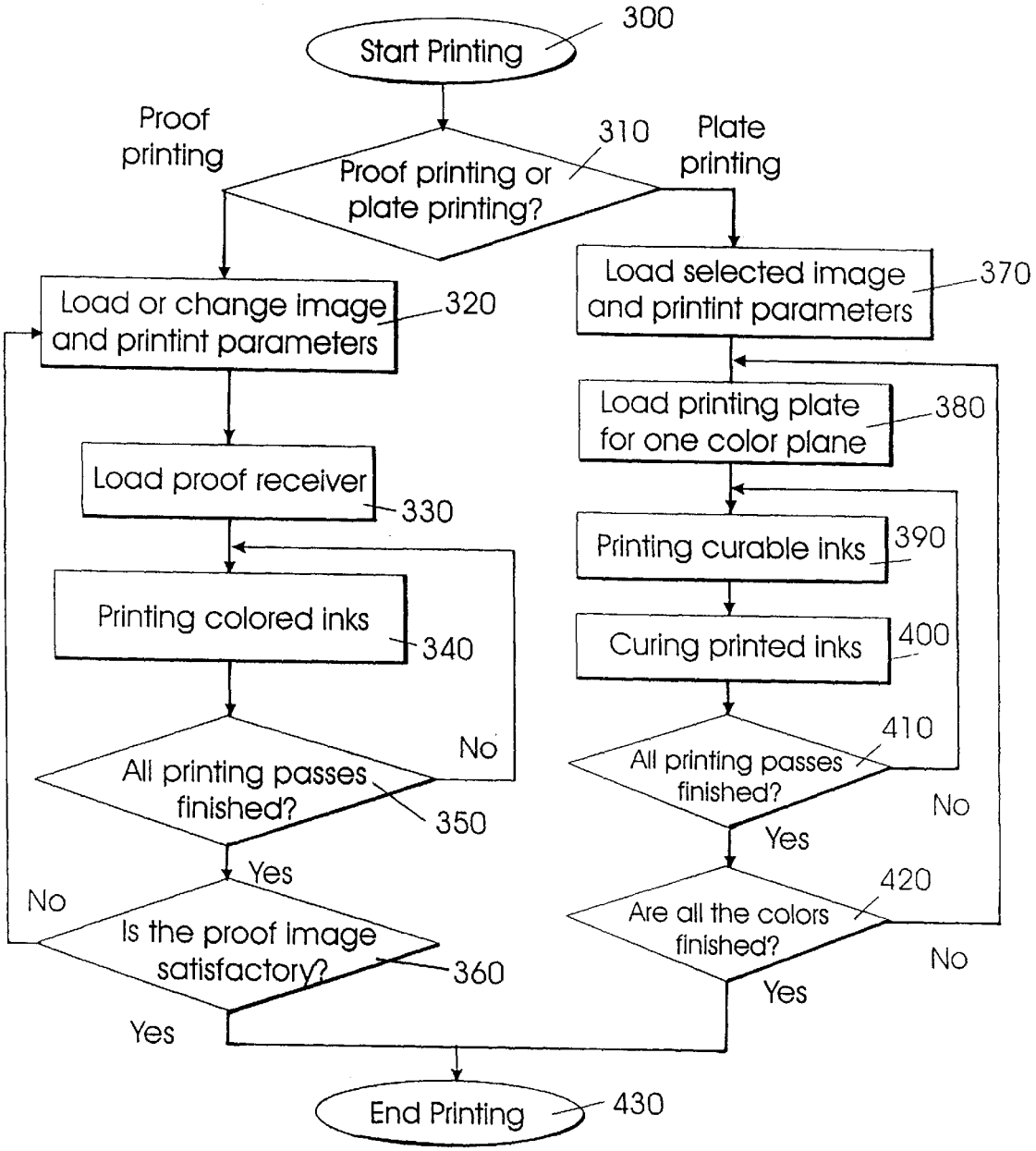
FIG. 3 is a flow chart of the operation of the apparatus of FIGS. 1 and 2.

A flow chart of the operation of the drop-on-demand ink jet printing apparatus 10 of FIGS. 1 and 2 is shown in FIG. 3. The printing operation is started in block 300 in which the computer 20 receives or generates a digital image. A question is then asked in block 310 whether a proof image is to be printed or a lithographic printing plate is to be prepared. If a proof image is to be printed, an image and printing parameters are loaded into the computer 20 in block 320. A proof image receiver 80 is loaded on the drop-on-demand ink jet printing apparatus 10 in block 330. In block 340, the computer 20 controls the receiver transport 70 to move the proof image receiver 80 under the print heads 31–34. In each printing pass, the computer 20 sends control signals to the print heads 31–34 for it to transfer colored ink drops 100 to the proof image receiver 80 according to the input digital image. Then a question is asked whether all the printing passes are finished in block 350. If the answer is no, the remaining printing passes are similarly printed in block 340. If the answer is yes, the proof image is reviewed by a selector and a question is asked in block 360 whether the proof image is satisfactory. If the proof image is satisfactory, the printing operation is ended in block 430. If the proof image is not satisfactory, the image and printing parameters are changed in block 320 for improvement. The same procedure is repeated from block 320 to block 360.

After a satisfactory proof image is selected by the selector, a lithographic printing plate can be produced in response to the question in block 310. The selected image and the printing parameters are first loaded onto the computer 20 in block 370. A lithographic printing plate 180 is loaded on the drop-on-demand ink jet printing apparatus 10 in block 380 for preparing each the printing plate for each color plane. The computer 20 controls the receiver transport 70 to move the lithographic printing plate 180 under the print head 30. The computer 20 sends control signals to the print head 30. The print head 30 transfers curable ink drops 200 to the lithographic printing plate 180 according to the satisfactory digital image in that color plane in block 390. As the curable ink spots 210 on the lithographic printing plate 180 are transported under the UV light source 50, the computer 20 sends control signal to the power supply 60 to activate the UV light source 50 to cure the curable ink spots 210 in block 400. The cured ink spots 220 are shown in black in FIG. 2 on the lithographic printing plate 180. The radiation treatment in block 400 is implemented on-the-fly, no additional time is required for the printing pass.

After one printing pass is finished, a question is asked in block 410 whether all the printing passes are finished. If not, the subsequent printing passes will be conducted in the sequence of ink transfer and radiation treatment in each printing pass in blocks 390 and 400. After all the printing passes are finished, the lithographic printing plate 180 of this color can be treated by an additional radiation treatment. The lithographic printing plate 180 of this color is now completed. A question is then asked in block 420 about whether lithographic printing plate 180 of all the color planes are finished or not. If the answer is no, the lithographic printing plate 180 of another color is prepared in the same sequence of blocks 380 through 410. If the answer is yes to the question in block 390, the printing operation is ended in block 430.

The invention has been described in detail with particular reference to certain preferred embodiments thereof, but it will be understood that variations and modifications can be effected within the spirit and scope of the invention.

PARTS LIST

10 drop-on-demand ink jet printing apparatus
20 computer
30–34 print heads
40–44 ink reservoirs
50 uv light source
60 power supply
70 a receiver transport
80 proof image receiver
90 platen
100 colored ink drop
110 colored ink spot
180 lithographic printing plate
200 curable ink drop
210 curable ink spot
220 cured ink spot
300 start printing
310 proof printing or plate printing?
320 load or change image and printing parameters
330 load proof receiver

340 printing colored inks
350 all printing passes finished?
360 is the proof image satisfactory?
370 load selected image and printing parameters
380 load printing plate for one color plane
390 printing curable inks
400 curing curable inks
410 all printing passes fmished?
420 are all the colors finished?
430 end printing

What is claimed is:

1. A drop-on-demand ink jet printing apparatus for printing proof images on receivers and then producing at least one lithographic ink image on a lithographic printing plate in response to an input image, comprising:

a) a computer adapted to receive an input digital image;

b) a plurality of ink reservoirs for providing inks of different colors for printing proof images on the receivers and at least one lithographic ink reservoir for producing a lithographic ink image on the lithographic printing plate;

c) first print head means coupled to a proof image receiver and responsive to the computer for transferring particular inks onto the proof image receiver for producing proof images; and d) second print head means responsive to the computer for transferring lithographic ink from the lithographic ink reservoir to form an image pattern on the lithographic printing plate.

2. A drop-on-demand ink jet printing apparatus for printing proof images on receivers and then producing a plurality of lithographic ink images on lithographic printing plates in response to an input image, comprising:

a) a computer adapted to receive an input digital image;

b) a plurality of ink reservoirs for providing inks of different colors for printing proof images on the receivers and at least one lithographic ink reservoir for producing lithographic ink images on the lithographic printing plates;

c) first print head means coupled to a proof image receiver and responsive to the computer for transferring particular inks onto the proof image receiver for producing proof images; and d) second print head means responsive to the computer for transferring lithographic ink from the lithographic ink reservoir to form image patterns on a series of lithographic printing plates.

3. A drop-on-demand ink jet printing apparatus for printing proof images on receivers and then producing a plurality of curable ink images on lithographic printing plates in response to an input image, comprising:

a) a computer adapted to receive an input digital image;

b) a plurality of ink reservoirs for providing inks of different colors for printing proof images on the receivers and at least one lithographic ink reservoir for providing a curable ink which is adapted to provide curable ink to produce curable ink lithographic images on the lithographic printing plates;

c) first print head means coupled to a proof image receiver and responsive to the computer for transferring particular inks onto the receivers for producing proof images;

d) second print head means responsive to the computer for transferring curable lithographic ink from the lithographic ink reservoir to form curable ink image patterns on the lithographic printing plates; and e) means for curing the curable lithographic ink patterns transferred to the lithographic printing plates.

4. The ink jet printing apparatus of claim 3 wherein the curing means includes a source of radiation that is responsive to the computer for treating the transferred curable lithographic ink on the lithographic printing plates by radiation.

5. The ink jet printing apparatus of claim 3 wherein the lithographic printing plates are produced and the curing means includes a source of radiation that is responsive to the computer for treating the transferred curable lithographic ink on the lithographic printing plates by radiation.

* * * * *